United States Patent [19]

Watanabe et al.

[11] Patent Number: 4,932,429

[45] Date of Patent: Jun. 12, 1990

[54] SCREW STOPPER INCLUDING ANTI-FREEZE DEVICE USED FOR WATER PIPE VALVE

[76] Inventors: Masatoshi Watanabe, 47, Kashiage-cho, Seki-City, Gifu-Pref., 501-32; Shinichi Hayakawa, 131-2, Imojiya, Seki-City, Gifu-Pref., 501-32; Shiro Tsuji, 277, Ueno, Mino-City, Gifu-Pref., 501-37; Yasuyuki Sumigama, 2-13, Mukoyama-cho, Seki-City, Gifu-Pref., 501-32; Naotake Okada, 95-3, Kurachi, Seki-City, Gifu-Pref., 501-32; Genko Kitamura, 9, Sakuragi-cho, Seki-City, Gifu-Pref., 501-32, all of Japan

[21] Appl. No.: 311,591

[22] Filed: Feb. 16, 1989

[30] Foreign Application Priority Data

Feb. 19, 1988 [JP] Japan ..... 63-37727

[51] Int. Cl.[5] ..... F16K 31/64; E03B 7/12

[52] U.S. Cl. ..... 137/62; 60/527; 116/218; 137/468; 236/101 D; 237/80; 251/11

[58] Field of Search ..... 137/59, 60, 62, 79, 137/468; 236/66, 93 R, 101 D, 101 R; 237/80; 251/11; 374/197; 60/527, 528, 525; 116/216, 218

[56] References Cited

U.S. PATENT DOCUMENTS

| | | | |
|---|---|---|---|
| 1,067,409 | 7/1913 | Daniel | 137/60 |
| 1,134,882 | 4/1915 | Lowe | 137/62 |
| 3,403,238 | 9/1968 | Buehler et al. | 137/79 |
| 4,066,090 | 1/1978 | Nakajima et al. | 137/62 |
| 4,344,450 | 8/1982 | Walters | 137/62 |
| 4,522,219 | 6/1985 | Ohkata | 137/62 |
| 4,523,605 | 6/1985 | Ohkata | 137/62 |
| 4,638,828 | 1/1987 | Barrineau, Sr. et al. | 137/62 |

FOREIGN PATENT DOCUMENTS

| | | | |
|---|---|---|---|
| 60-323542 | of 1985 | Japan . | |
| 0263790 | 12/1985 | Japan | 137/62 |

*Primary Examiner*—George L. Walton

*Attorney, Agent, or Firm*—Jason M. Honeyman; Peter F. Corless

[57] ABSTRACT

This invention relates to a screw stopper including an anti-freeze device used for water pipe valve and fitted to the lower end portion of an open/close movable valve of said water pipe valve comprises: a small perforation penetrated centrally on the lower portion of the said screw stopper; a water-through recess formed on a countersink portion of the said screw stopper; a small movable member including a small valve for opening and closing an aperture of the said small perforation, and said small movable member partially defining an water-through passage; a pair of springs for holding said small movable member, at least of which is made of shape-memory alloy; an outer cylinder for holding said pair of springs screwed and fitted to the said screw stopper; and a packing for sealing up water by a valve seat.

1 Claim, 3 Drawing Sheets

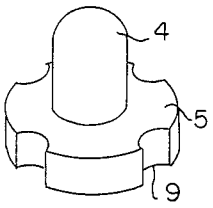
FIG. 4
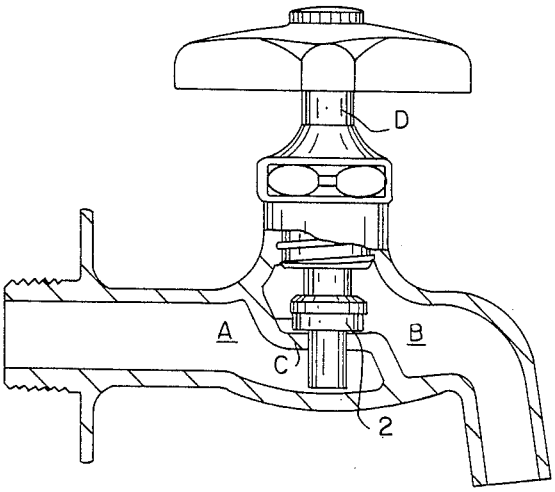
FIG. 5
FIG. 6
(PRIOR ART)
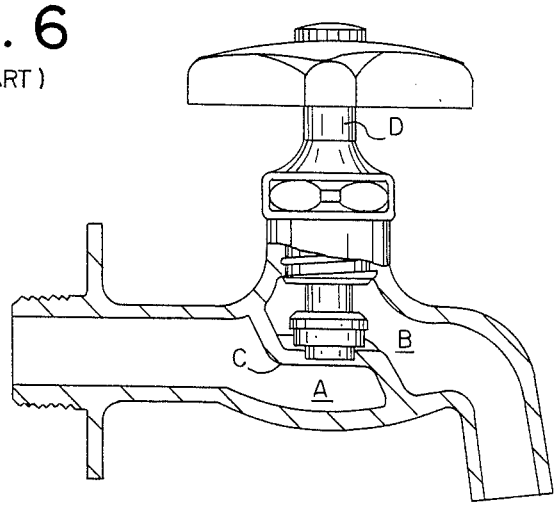

SCREW STOPPER INCLUDING ANTI-FREEZE DEVICE USED FOR WATER PIPE VALVE

BACKGROUND OF THE INVENTION

Conventionally, for the purpose of preventing water in the water pipe valve from freezing in winter season at cold districts, it has been proposed a device, in which a water pipe valve was controlled so as to be slightly opened in order to flow a water continuously at a little amount, which is comparatively warm because of being flown from the duct under the ground.

The valve designed for performing this above-mentioned operation was disclosed in the Japanese Unexamined Gazette of the Patent Application No. 60-223542. However, this valve as above has to be complicated structures, in which a screw stopper for the water pipe valve was entirely remodelled newly to be provided with a spring made of shape-memory alloy.

So, for the purpose of accomodating a screw stopper as above, it must be large in size and bulky. It was a problem to exchange a screw stopper and/or a water pipe valve for especially prepared larger and complicated one. This fact leads to the defect of high cost in their construction.

SUMMARY OF THE INVENTION

Therefore, it has been desired to obtain an inexpensive means which can prevent water from freezing without an entire replacement of the water pipe.

An object of the present invention is to provide a screw stopper used for a water pipe valve with an anti-freeze device, available in winter season at cold districts, which realizes by exchanging just a partial replacement of a screw stopper, without a replacement of main devices of conventional water pipe.

In this invention, a screw stopper is provided with an anti-freeze device fitted to the lower end portion of an open/close valve in the water pipe. That is to say, a screw stopper including an anti-freeze device used for a water pipe valve is characterized in that it includes; a small perforation penetrated centrally on the lower portion of the screw stopper; a water-through recess formed on the countersink portion of the screw stopper; a small valve for opening and/or closing the above small perforation; a small movable member partially defining the water passage thereon; a pair of springs for holding the above small movable member, at least either of which is made of shape-memory for changing the shape of itself by sensing a temperature in water; an outer cylinder screwed and fitted to the screw stopper, for holding the above pair of springs and for holding and accomodating the above small movable member; and a packing for sealing up water bt the valve seat.

In winter season, an easy replacement of the conventional screw stopper by the present one enables to prevent water from freezing by flowing in the water pipe.

By way of example and to make descriptions clear, reference is made to the accompanying drawings in which;

FIG. 4 is a perspective view of a small movable member;

FIG. 5 is a cross-sectional view of the water pipe valve, wherein the a screw stopper according to the present invention is used;

FIG. 6 is a cross-sectional view of a valve according to the prior art; and

DESCRIPTION OF PREFERRED EMBODIMENT

While a specification concludes with claims particularly pointing out and distinctly claiming the subject-matter of the invention, it is believed the invention will be better understood from the following description taken in connection with the accompanying drawings.

Figure 1:
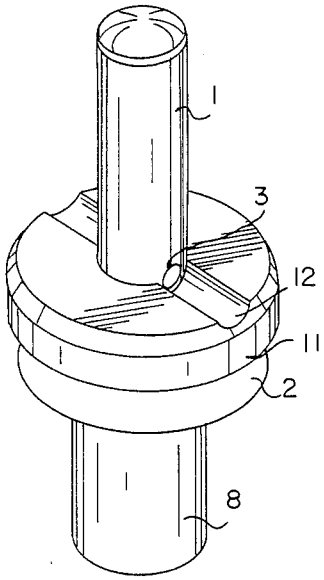
FIG. 1 is a perspective view of a screw stopper for a water pipe valve according to the present invention.
Figure 2:
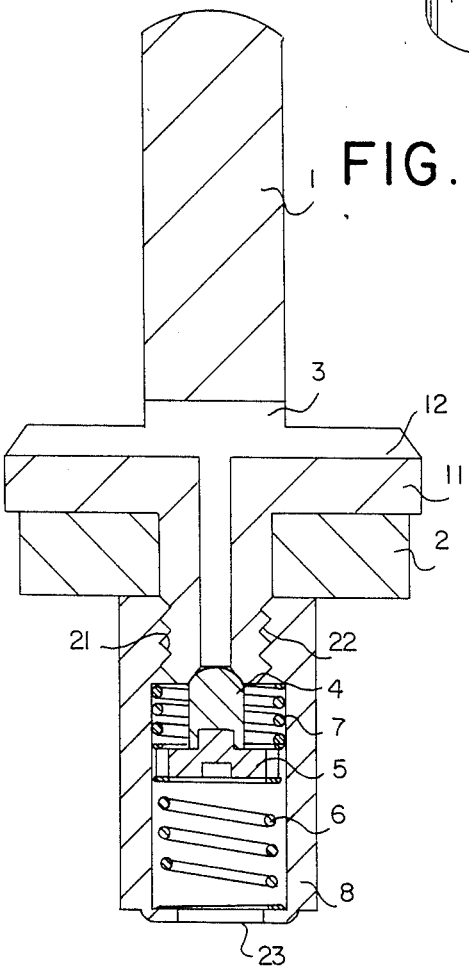
FIG. 2 is a cross-sectional view of a screw stopper in which a small perforation is closed.
Figure 3:
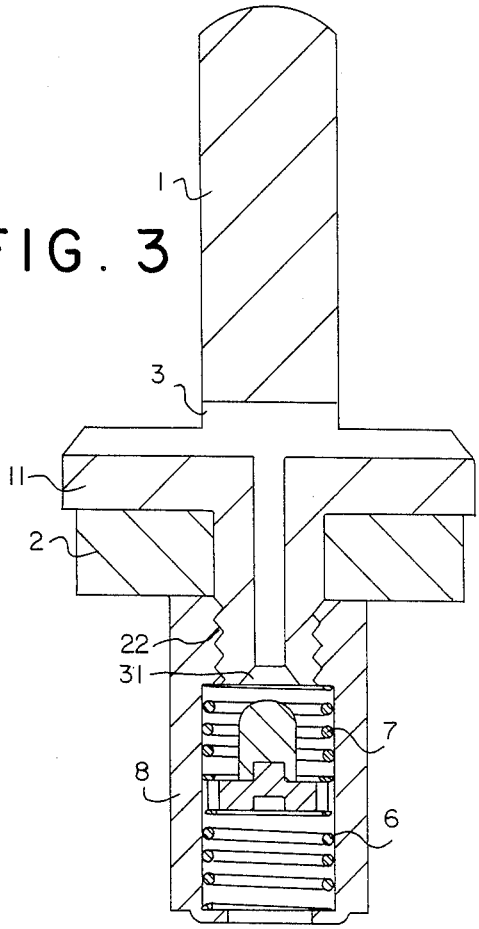
FIG. 3 is a cross-sectional view where the small perforation is opened.

Referring to FIG. 2 and FIG. 3, each shows the cross-sectional view of the screw stopper according to the present invention.

A small perforation (3) is penetrated centrally on the lower portion of the screw stopper. An example of the screw stopper (1) has a longitudinal axis which diameter is about 5 mm, while the small perforation (3) has a diameter of about 1 mm~2 mm.

The small perforation (3) penetrates through in the vertical direction, extends from the lower end portion of the screw stopper (1) and changes the extending direction to the horizontal direction at the countersink portion (11) of the screw stopper (1).

The countersink portion (11) of the screw stopper (1) defines a water-through recess (12) which is lead to the small perforation (3).

An aperture (31) at the lower portion extended from the small perforation (3) is tapered for facilitating a sealing of the small perforation (3) by the small valve (4) hereinunder described.

When the small perforation (3) is in opened state, the lower valve chamber (A) communicates with the upper valve chamber (B).

That is to say, water in the water pipe flows from the lower valve chamber (A) to the upper chamber (B) through the small perforation (3), even though an open/close movable valve (D) is in the closed state and a valve seat (C) is sealed up by, namely, closed by the packing (2) of the screw stopper (1).

As mentioned hereinabove, even when the valve seat (C) is closed by the packing (2), the aperture (31) of the small perforation (3) is communicated and the water stops to flow completely by closing the aperture (31).

For opening or closing the aperture (31) of the small perforation (3), as shown in the FIG. 4, a small movable member (5) to which a hemisphere-shaped small valve (4) made of rubber or something, defining a water passage (9) around and functioning as a packing, is attached at the upper portion thereof, is applied. When the small movable member (5) is raised its portion to seal up the aperture (31) of the small perforation (3) by the hemisphere-shaped small valve (4) which is attached to the small movable member (5) as a packing, the aperture (31) of the perforation (3) is closed and the lower chamber (A) is made to be discommunicated to the upper chamber (B). The water in the lower chamber (A) does not flow through into the upper chamber (B), and as a result, the water from the water pipe valve is completely interruped.

FIG. 2 shows the cross-sectional view of the screw stopper in the above closed state.

When repulsion of the spring (6) made of shape-memory alloy hereinunder described is substantially suppress to the upper portion to seal the aperture (31) of the perforation (3) by means of the small movable member (5) having the small valve (4), the water flow is completely interrupted. This is under the normal condition for the water pipe valve.

Water hardly freezes in the valve in winter season when the spring (6) made of shape-memory alloy senses movement in water's temperature and then changes its shape, as shown in FIG. 3. Specifically, when the spring (6) made of the shape-memory alloy senses movement in water's temperature and then becomes contracted, the small movable member (5) moves to the lower position because of the repulsion of the oppsite spring (7) and the small valve (4) attached to the small movable member (5) is detached from the the aperture (31) of the small perforation (3). So, water in the lower chamber (A) flows through both the small perforation (3) and a water passage (9), responsive to the water pressure in the pipe duct. Then water flows through a small perforation (3) and a water-through recess (12) to the upper chamber (B). When water begins to flow through in the screw stopper (1), water from the duct which is comparatively warm, flows into the water pipe valve, and thus it enables to raise the water's temperature and prevent water in the water pipe valve from freezing.

A spring (6) made of shape-memory alloy memorizes to contract itself at the temperature of 0~−1° C. and to loose repulsion as spring feature, while restoring the original shape when the water's temperature becomes in the range of 2° C.~3° C. When the water temperature becomes above 2° C.~3° C., the spring (6) recovers the feature as a spring, repulsion of the spring (6) exerts to the small movable member (5) to substantially suppress a repulsion of the opposite spring (7). Thus, it is necessary to adjust the small valve (4) so that the small valve (4) closes the aperture (31) of the small perforation (3) again at that temperature.

An outer cylinder (8) is provided for holding inside both the abovementioned pair of springs (6)(7) and the small movable member (5) to fix them to the screw stopper (1). The outer cylinder (8), as shown in FIG. 2, is screwed and fitted to the screw stopper (1) by means of a male screw (21) which is conventionally used for fixing a nut (20) to a packing (2).

The outer cylinder (8) includes a female screw portion (22) formed on the upper end portion thereof for fitting itself to the screw stopper (1), while the lower end portion of the outer cylinder (8) is shaped as like as a small pipe having a water-through hole (23). The outer cylinder (8) is formed in the size capable to be accomodated in the lower chamber (A) of the water pipe valve, as shown in FIG. 5.

Figure 7:
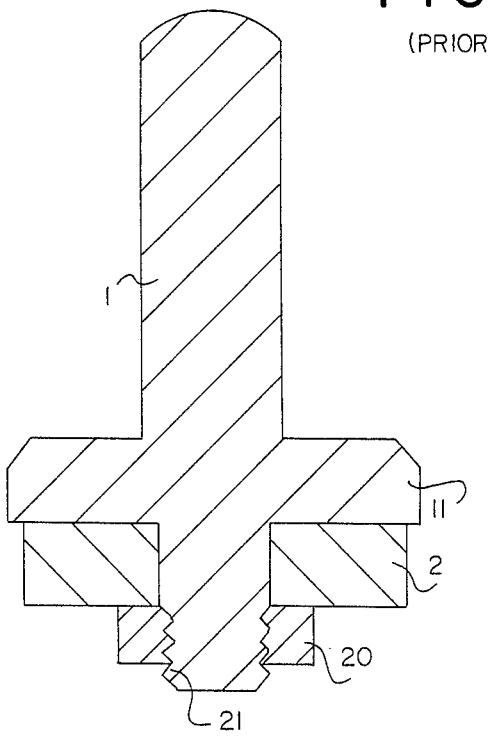
FIG. 7 (PRIOR ART)
FIG. 7 is a cross-sectional view of a screw stopper used for a valve according to the prior art.

For sealing up the water by a valve seat (C), a packing (2) according to the prior art may be available. However, a method for fixing the packing to the screw stopper (1) is different. According to the prior art, the packing (2) is fixed to the screw stopper (1) by means of a nut (20) as shown in FIG. 7. But, according to the present invention, the packing (2) is fixed to the screw stopper (1) on the upper portion of the outer cylinder (8) as shown in FIG. 2 and FIG. 3. Therefore, the present invention is excellent in stability in the fixed condition in comparison with the prior art.

The screw stopper for the water pipe valve which is structured as above can be used only by the partial replacement of the screw stopper.

The screw stopper as above does not need any replacement of the mechanical part, such as water duct nor any care for the maintenance even in winter season. The freezing of the water in the water pipe valve is prevented, although the it is used under the usual conditions.

Furthermore, the screw stopper for the water pipe as above eliminates an aid of a manual adjustment for anti-freezing by opening the valve slightly so that the water in the water valve flows out of the outlet plug as before. Accordingly, unnecessary water-flowing is saved.

What is claimed is:

1. A screw stopper valve having an inlet and an outlet, said stopper valve including an anti-freeze device connected to an open/close movable valve member of said stopper valve for an inlet duct, said screw stopper comprising:

a longitudinally extending valve stem body having a longitudinally extending bore and a transversely extending bore therewithin;

said longitudinally extending bore having a first end and a second end, said first end terminating at said transversely extending bore and being in communication therewith:

a countersink portion annularly extending outwardly from said longitudinally extending body, said countersink portion having a channel extending across a surface thereof, said channel extending between said transversely extending bore and an annular ledge portion of said countersink portion to provide fluid communication therebetween and into said outlet;

said longitudinally extending body having a hollow chamber contiguous at a first end with said second end of said longitudinally extending bore, a second end of said hollow chamber being in communication with the inlet duct;

a valve seat positioned within said hollow chamber at said first end, said valve member having a plurality of peripherally spaced openings extending therethrough to allow fluid communication to said outlet;

said valve member being aligned with and facing said longitudinally extending bore for engaging and disengaging said valve seat;

a shape memory alloy spring positioned within said hollow chamber and fixed at one end to said valve member and at another end to an inner surface of said hollow chamber whereby said shape memory alloy spring moves said valve member toward and away from said seat in response to temperature changes for regulating fluid communication between said inlet and said outlet.

* * * * *